US007628565B2

(12) United States Patent
Melegari

(10) Patent No.: US 7,628,565 B2
(45) **Date of Patent: *Dec. 8, 2009**

(54) DRAINAGE PIPE

(76) Inventor: Cesare Melegari, Via Boschi 25, Noceto (PR) (IT)

( * ) Notice: Subject to any disclaimer, the term of this patent is extended or adjusted under 35 U.S.C. 154(b) by 32 days.

This patent is subject to a terminal disclaimer.

(21) Appl. No.: 11/905,536

(22) Filed: Oct. 2, 2007

(65) Prior Publication Data

US 2008/0078585 A1 Apr. 3, 2008

(30) Foreign Application Priority Data

Oct. 2, 2006 (IT) ..... PC2006A0044

(51) Int. Cl.
*E02B 11/00* (2006.01)

(52) U.S. Cl. ..... 405/45; 405/43

(58) Field of Classification Search ..... 405/43–45, 405/47, 48, 49, 50; 166/296, 376
See application file for complete search history.

(56) References Cited

U.S. PATENT DOCUMENTS 1,750,871 A * 3/1930 Wilson ..... 166/229
2,391,609 A * 12/1945 Wright ..... 166/228
3,936,380 A * 2/1976 Boske ..... 405/45
4,650,367 A * 3/1987 Dietzler ..... 405/43
6,202,750 B1 * 3/2001 Ohanesian ..... 166/236
6,561,732 B1 * 5/2003 Bloomfield et al. ..... 405/43
7,258,166 B2 * 8/2007 Russell ..... 166/229
7,455,480 B2 * 11/2008 Melegari ..... 405/43
2001/0042620 A1 * 11/2001 Ohanesian ..... 166/228
2008/0080931 A1 * 4/2008 Melegari ..... 405/43

* cited by examiner

*Primary Examiner*—Frederick L Lagman
(74) *Attorney, Agent, or Firm*—Young & Thompson

(57) ABSTRACT

A drainage pipe to be inserted into the ground, presents a plurality of openings (5) for the passage of water, wherein each of the openings is closed by a cap (9) containing one or more holes (11) filled with water-soluble material (13), adapted to prevent the passage of debris during drilling, which the material dissolves in contact with the water in the soil. In particular, the caps have a hollow body (9) with a plurality of holes (11) in the wall for the passage of water, which the body and holes are filled with water-soluble material (13). Moreover, the caps present an undercut (12) on the end wall of the cavity, to prevent the exit of the water-soluble material (13) which fills the hollow body (9).

8 Claims, 3 Drawing Sheets

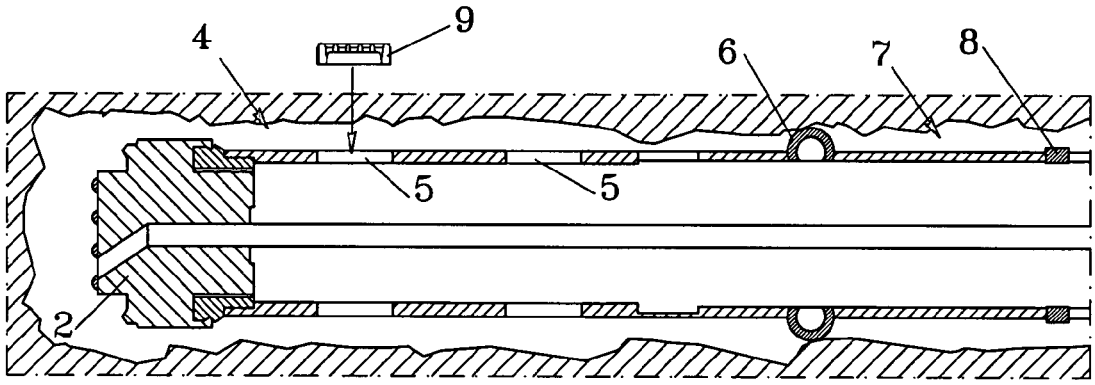
Fig. 3
Fig. 4
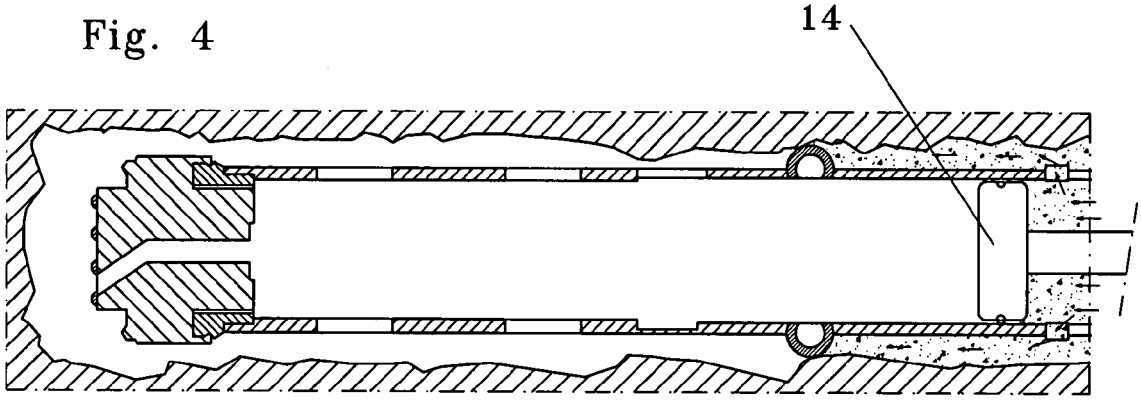
Fig. 5
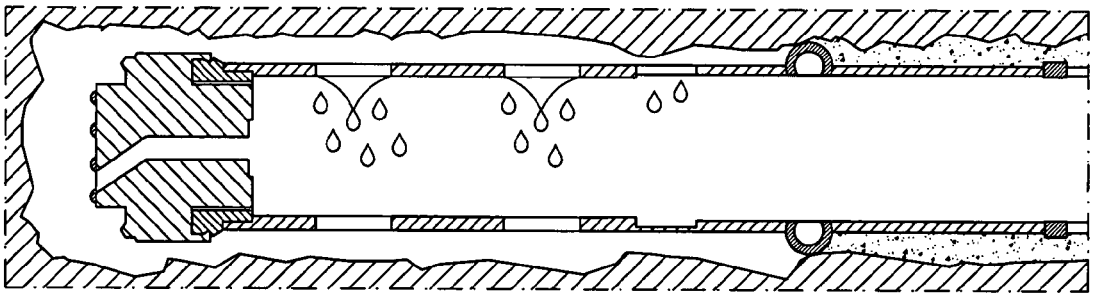

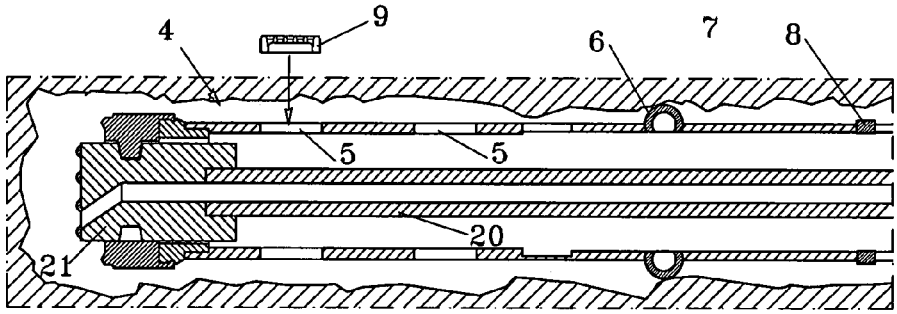
Fig. 6
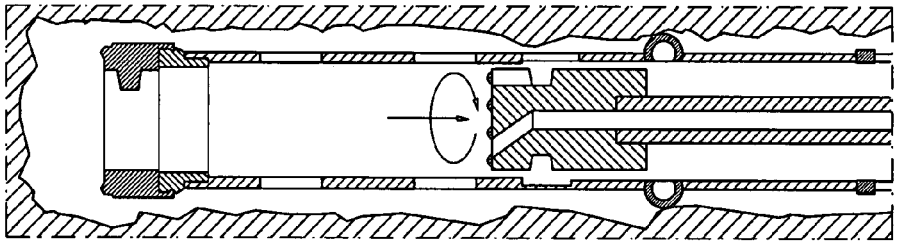
Fig. 7
Fig. 8
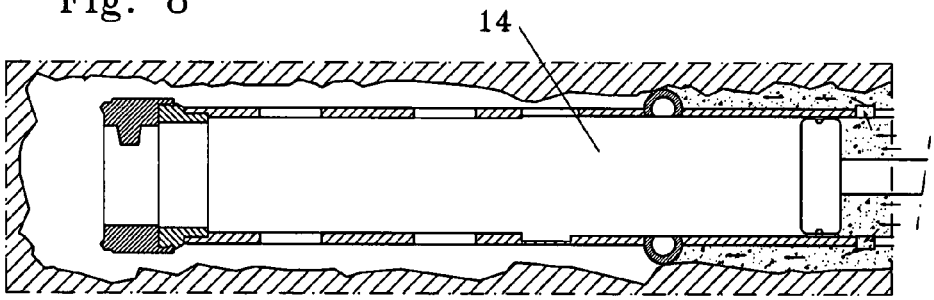
Fig. 9
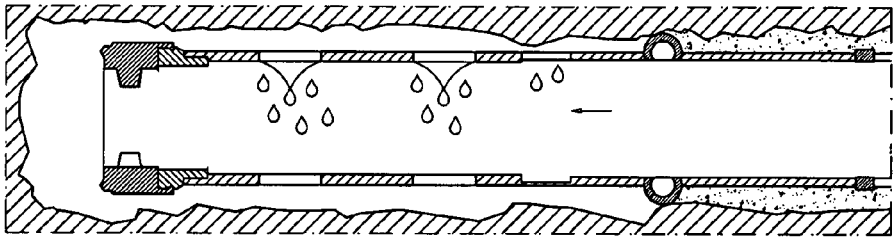

DRAINAGE PIPE

This invention relates to an improved drainage pipe which presents, on the surface, a plurality of openings for the passage of water, said openings being closed by caps which are perforated and filled with a water-soluble material.

In this way, debris is prevented from passing through the openings during drilling and obstructing them, while the subsequent dissolution of the water-soluble material when it comes into contact with the water in the soil completely clears said openings, thus guaranteeing the functionality of the system.

Soil drainage is usually effected by inserting pipes, usually made of plastic such as PVC, into the ground, which said pipes have openings for the passage of water and may be covered with a geotextile fabric.

For this purpose, the soil is usually drilled with a drilling rod fitted at the tip with a bit, which pulls a metal covering pipe with it as it advances. When the required depth has been reached, the drilling rods are removed and the metal pipe, inside which the PVC drainage pipe is inserted, is left in the ground.

When the drainage pipe is in position, the outer metal pipe can be removed and reused, while the PVC pipe with the openings and slots for the passage of water remains in the ground, at the required depth, thus allowing water drainage.

This solution, which has been in use for many years, is rather laborious, and requires skilled personnel and the use of very expensive equipment for a long time.

Italian patent no. 1,309,609 describes a method of inserting a drainage pipe into the ground, which uses a drilling rod fitted at the tip with a disposable bit, to which the drainage pipe is connected.

The bit and the drainage pipe remain inserted in the soil.

Italian patent application no. PC 2005A 015, filed by the same applicant, describes equipment and a method for inserting drainage devices in the soil wherein (i) rods with particular coverings containing holes distributed along the wall are used for drilling, so that said coverings, which are left in the ground when the required depth has been reached, also act as drainage pipes, and (ii) a removable bit is used for drilling.

Both the said patents involve protecting the drainage pipe, during drilling, with a sheath made of water-soluble material, which dissolves within a few days or hours when it comes into contact with the water present in the soil. The use of said protective layer is necessary to ensure that the debris produced during excavations does not obstruct the openings in the pipe, thereby reducing its functionality.

However, despite this system, problems still sometimes occur, because said outer sheath is often lacerated by the advance of the pipe among debris, stones, outcrops of rock and so on, with the result that the debris reaches the openings in the pipe.

In particularly difficult terrain, this constitutes a considerable problem, because in some cases the sheath is lacerated at the start of drilling, thus leaving the pipe entirely uncovered, with the result that the openings are almost entirely obstructed.

Said problem is now solved by the present invention, which relates to an improved drainage pipe, consisting of a simple steel pipe which presents, on the wall, a plurality of holes filled with water-soluble material which prevents debris from entering the hole during drilling, but dissolves when it comes into contact with water when the required depth is reached.

In particular, said holes are closed by valves or caps which are fixed to the wall of pipe, for example by screwing them into said seatings, and are entirely hollow, with a perforated wall.

Said cavity is packed with water-soluble material which dissolves within a few hours, after the drainage pipe has been laid in the ground.

The pipe with holes closed by valves according to the invention can be used with both the above-mentioned systems, namely with pipes fitted with either a disposable bit or a removable bit.

This invention will now be described in detail, by way of example but not of limitation, by reference to the annexed figures wherein:

FIG. 1 is a schematic view of a drainage pipe according to the invention;

FIGS. 2*a* and 2*b* show a view and cross-section respectively of one of said caps;

FIGS. 3 to 5 illustrate in cross-section the distal part of a drainage pipe according to the invention, of the type with a disposable bit, during drilling and grout injection, and after laying, respectively;

FIGS. 6 to 9 illustrate in cross-section the distal part of a drainage pipe according to the invention, of the type with a removable bit, during drilling, bit removal and grout injection, and after laying, respectively.

Figure 1:
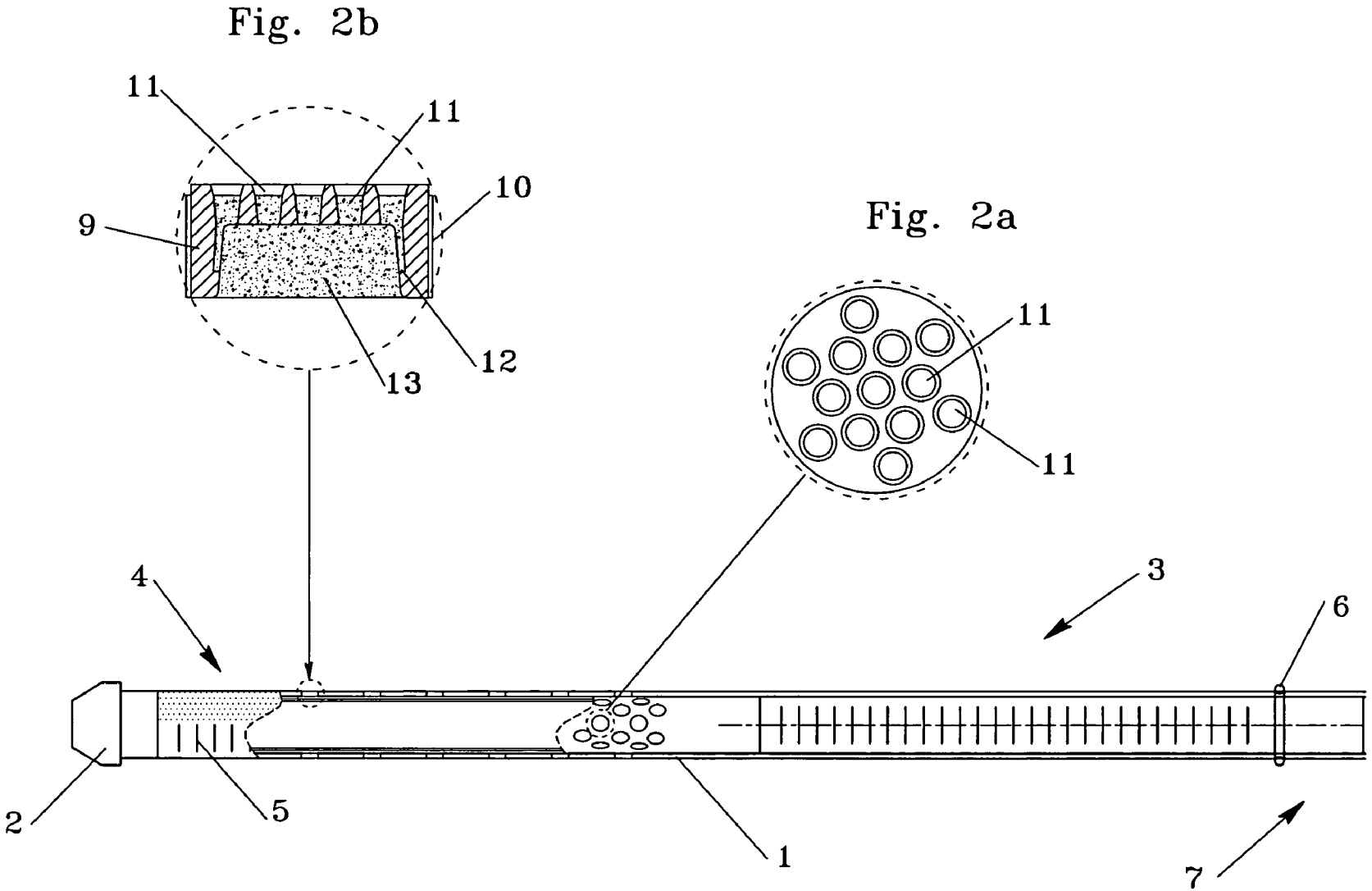

In the annexed figures, no. 1 indicates a drilling rod, fitted at the tip with a bit 2, which may be a sacrificial bit left in the ground, as in the case illustrated in FIGS. 1 to 5, or a removable bit as in the case illustrated in FIGS. 6 to 9.

In accordance with a preferred embodiment of the invention, in the case of a rod with a disposable bit, the rod is advantageously constituted by drainage pipe assembly 3, which is left in the ground when the required depth has been reached.

The drilling rod, bit and the corresponding connection systems will not be described, as they are already known or illustrated in other applications by the same applicant.

Front section 4 of the drainage pipe (see detail in FIG. 3) contains a series of openings 5 through which water passes, and is then evacuated by flowing through the pipe.

A gasket of known type 6 forms the seal between the drainage pipe and the wall of the hole in which the pipe is inserted, and separates the perforated distal part of the drainage pipe from the remaining part, shown as 7.

A series of valves 8, for the passage of a cement grout mixture, is made in the front part of the drainage pipe, immediately upstream of perforated section 5 (FIG. 3).

A characteristic feature of the invention is holes 5 in the wall of the pipe, which are closed by valve elements or caps 9, illustrated in the detail shown in FIGS. 2 and 2*a*.

According to a preferred embodiment, said closing elements consist of round caps, which have a thread 10 on the edge that enables them to be screwed into hole 5, also threaded, and which present a plurality of holes 11 for the passage of liquids.

The body of element 9 is hollow thereby providing a cavity, and shaped to form an undercut 12 on the wall of said cavity, which is packed with a water-soluble material, such as Hydrolene, shown as 13.

The system operates as follows.

During drilling, rod 1 with bit 2 is caused to advance until the required depth is reached.

The debris created during excavations cannot obstruct holes 11 in caps 9, because said caps are filled with water-soluble material, which is solid and firm.

When the required depth has been reached, a "packer" or inner gasket 14 is inserted in the drainage pipe, and positioned immediately downstream of valves 8 (see FIG. 4).

A cement grout mixture is then injected along the drainage pipe, exits from valves 8 and fills the space between the drainage pipe and the wall of the excavation, along the whole length thereof apart from the section downstream of gasket 6 where the terminal part 4 of the pipe is located, with openings 5 closed by caps 9.

When the grouting stage has been completed, packer 14 can be extracted, and the system is ready to operate.

Within a few hours, water-soluble material 13 that fills caps 9 and holes 11 dissolves in contact with the water in the soil, thus clearing the passages and allowing water to flow into the pipe, from which it is discharged (FIG. 6).

Openings 5 and the corresponding closing elements may take any form; for example they could be round, as illustrated in the figure, elongated, or of different shapes and sizes, although the round shape has proved the most practical, because it allows closing elements 9 to be threaded, and fitted simply by screwing them into the wall of the pipe.

FIGS. 6 to 9 show a further version of the invention, wherein a drilling rod 20 with removable bit 21 is used.

Drainage pipe 3 is connected to said drilling rod, pulled by said rod during the descent, and left in the ground when the required depth has been reached.

When the required depth has been reached, drilling rod 20 and bit 21 are recovered (FIG. 7), and packer 14 is inserted, so that the cement grout mixture can be injected into the space between the drainage pipe and the wall of the excavations (see FIG. 5).

At the end, packer 14 is removed, and the system is ready to operate; water-soluble material 13, which fills caps 9 and holes 11, dissolves in contact with the water in the soil, thus clearing the passages and allowing water to flow into the pipe, from which it is discharged (FIG. 6).

The invention claimed is:

1. Drainage pipe (3) to be inserted into the ground, presenting a plurality of openings (5) for the passage of water, wherein each of said openings (5) is closed by a cap (9) containing one or more holes (11) filled with water-soluble material (13), in order to prevent the passage of debris during drilling, which said material dissolves in contact with the water in the soil.

2. Drainage pipe as claimed in claim 1, wherein each of said caps (9) consists of a hollow body with a plurality of holes (11) in a wall of said hollow body for the passage of water, which said body and holes are filled with water-soluble material (13).

3. Drainage pipe as claimed in claim 2, wherein said caps (9) present an undercut (12) on an end wall of said hollow body, to prevent the exit of said water-soluble material (13) which fills said hollow body.

4. Drainage pipe as claimed in claim 1, characterised in that said cap elements (9) consist of round threaded closing elements, designed to screw into corresponding seatings (5) in the wall of the drainage pipe (3).

5. Drainage pipe as claimed in claim 4, wherein said openings (5) for the insertion of said caps (9) are located in the distal part (4) of the pipe.

6. Drainage pipe as claimed in claim 5, wherein a series of valves (8) are provided, for the passage of a cement grout mixture, in the front part of the drainage pipe (3), immediately upstream of perforated section (4).

7. Drainage pipe as claimed in claim 3, characterised in that it is fitted at the tip with a bit (2), 80 that it can be used as a drilling rod.

8. Drainage pipe as claimed in claim 7, further including means which allow it to be connected to a drilling rod fitted at the tip with a bit and a coupling for connection to said pipe, so that said pipe is pulled by the rod during drilling.

* * * * *